United States Patent [19]

Meyers

[11] 4,124,161

[45] Nov. 7, 1978

[54] CARTON CLOSURE WITH SCORED FLAPS

[75] Inventor: George L. Meyers, Menasha, Wis.

[73] Assignee: American Can Company, Greenwich, Conn.

[21] Appl. No.: 843,330

[22] Filed: Oct. 18, 1977

[51] Int. Cl.[2] ..... B65D 5/06

[52] U.S. Cl. ..... 229/37 R

[58] Field of Search ..... 229/37 R, 38, 39 R, 229/48 T

[56] References Cited

U.S. PATENT DOCUMENTS

| | | | |
|---|---|---|---|
| 2,666,567 | 1/1954 | Farrell | 229/38 UX |
| 2,764,337 | 9/1956 | Bolding | 229/38 |
| 3,163,347 | 12/1964 | Bixler | 229/37 R |
| 3,191,847 | 6/1965 | Moore | 229/37 R |
| 3,194,474 | 7/1965 | Rumerger | 229/37 R |
| 3,334,802 | 8/1967 | Gooding | 229/37 R |
| 3,455,496 | 7/1969 | Franz | 229/37 R |
| 3,746,244 | 7/1973 | Bergstein | 229/37 R |
| 4,011,984 | 3/1977 | Matovich, Jr. | 229/37 R |
| 4,017,018 | 4/1977 | Pellaton | 229/39 R |

*Primary Examiner*—Davis T. Moorhead

*Attorney, Agent, or Firm*—Robert P. Auber; Ira S. Dorman; Ernest L. Brown

[57] ABSTRACT

A closure configuration for the top of a carton wherein the underneath flaps of the closure are scored to facilitate sealing.

7 Claims, 6 Drawing Figures

PRIOR ART

CARTON CLOSURE WITH SCORED FLAPS

BACKGROUND OF THE INVENTION

Typically the top of a box is closed by four flaps. Three of the flaps are positioned beneath the fourth or overlying flap.

When at least one of the flaps is made of plastic material or wax covered wherein a heated seal is contemplated between the plastics, the wax, wax to paperboard, or plastic to paper board, hot gases are broadcast onto the top of the underlying or bottom flaps and onto the bottom of the overlying flap. The overlying flap is then pressed downward onto the lower flaps to complete the plastics to plastics, wax to wax, plastics to board, or wax to board seal.

The hot gases directed to the underlying flaps cause the flaps to droop. The droop is caused by the expansion of the plastic material or wax on the top surface of the underlying flaps. When the overlying flap is pressed downward, it does not contact sufficient area of the underlying flaps to cause a good seal because the droop has moved the lower flaps away from the overlying flap. The seal, then, is merely at the flap hinge lines along the boundary of the box.

BRIEF DESCRIPTION OF THE INVENTION

The concept contemplated by this invention is to make a cut score along substantially the entire length of the top of the underlying flaps. The cut scores are indented from the fold lines of the flap to provide sealing margins. Each sealing margin is chosen wide enough to provide a good solid and strong seal with the top flap.

It may be observed that when the sealing gases are applied to the top of the underlying flaps, the flaps droop downward only between the cut score line and the edge of the flap. The margin between the fold line and the cut score line actually may move slightly upward toward the top flap or the droop may be compensated because of the spring of roll or crease scores at the fold line.

It is therefore an object of this invention to improve the sealing of a carton.

It is a more specific object of this invention to limit the droop of underlying flaps by placing a cut score line along substantially the full length of the flap.

BRIEF DESCRIPTION OF THE DRAWINGS

Other objects will become apparent from the following description, taken in connection with the accompanying drawings.

DETAILED DESCRIPTION OF THE INVENTION

Figure 1:
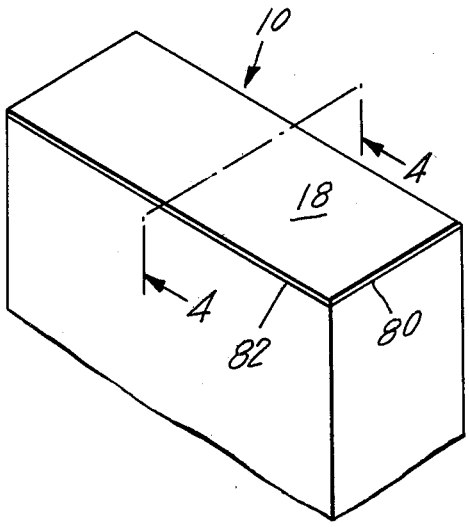
FIG. 1 is a perspective view of the outside top of a sealed carton.
Figure 2:
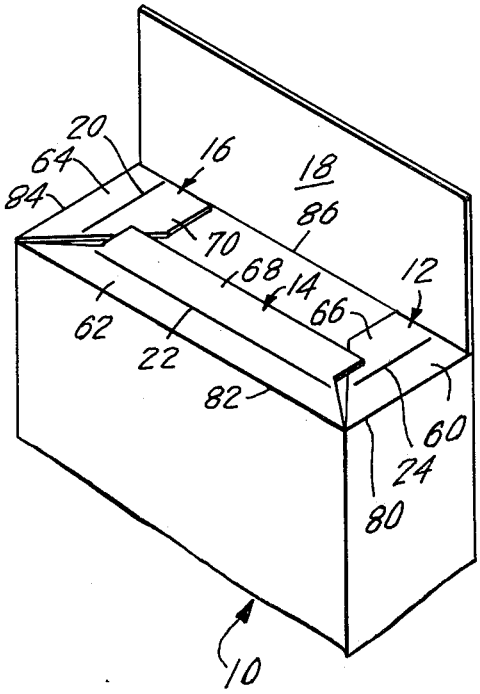
FIG. 2 is a perspective view of the top of a carton in accordance with this invention, with the top open preparatory to sealing.

Referring to the Figures, the top of a box 10 is closed by three underlying flaps 12,14,16 and one top or overlying flap 18 as shown particularly in FIG. 2 but formerly without the cut score lines 20,22,24 which are the subject matter of this invention. The flaps may be variously shaped, and the particular shape shown is not necessarily the preferred shape.

Figure 3:
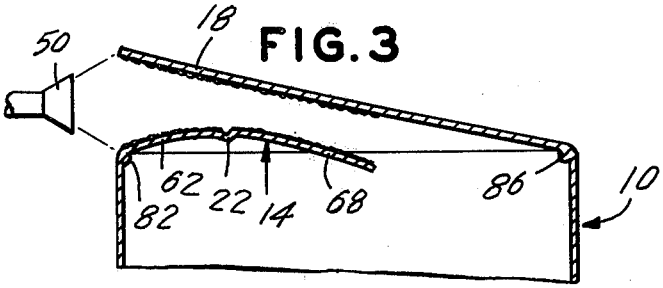
FIG. 3 shows the carton of this invention, in cross-section, with sealing gases being applied.

To seal the box, the lower flaps 12,14,16 are folded inward. The top flap 18 is bent forward as shown in FIG. 3. A blast of hot gas is delivered to the underside of the top flap 18 and to the top side of the underlying flaps 12, 14,16. The gas is delivered through a nozzle 50 from a source (not shown). The hot gas makes the heated surfaces expand, and in the prior art carton of FIG. 6, without cut scores, the underlying flaps 12,14,16 bow downward while the overlying flap 18 bows upward. The top is then pressed downward toward the botom flaps, but the bottom flaps are not pressed upward, whereby a seal 56 occurs in such prior art cartons only at the edge of the cartons, and the seal may actually be so narrow that it is defective and opens.

Figure 5:
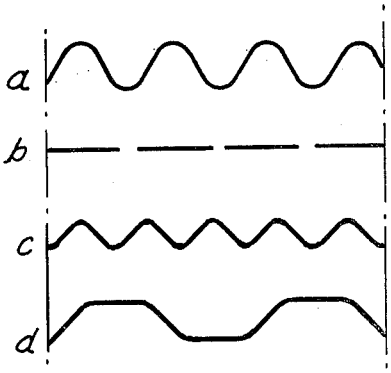
FIG. 5 shows alternative configurations of the cut score used on the flaps of the carton of this invention.

In accordance with the contemplated invention, cut score lines 20,22,24; typically about $\frac{1}{3}$ of the depth of the flaps 12,14,16, are made on the upper surface of at least one of the underlying flaps. The cut score lines are shown in FIG. 2 as straight and continuous, but the configurations of FIG. 5 are also useful and within the contemplation of the invention.

The cut score lines 20,22,24 divide the flaps into sealing margins 60,62,64 and interior margins 66, 68, 70. The sealing margins 60,62,64 are made wide enough that a good seal is made. Typically, they may be $\frac{1}{4}$ to $\frac{5}{8}$ inch in width.

The surface to surface seals may be of various plastic materials such as polyethyelene. They may, however, also be wax to wax seals, plastics to paper board, or ink or wax to paper board or ink.

Figure 4:
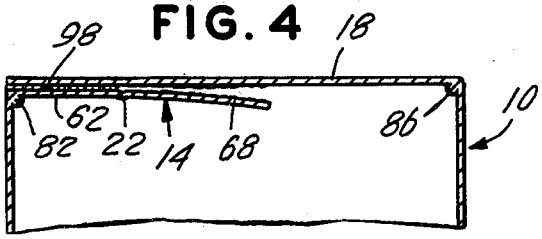
FIG. 4 shows the carton of this invention, in cross-section, taken at 4—4 in FIG. 1, with the top sealed closed.
Figure 6:
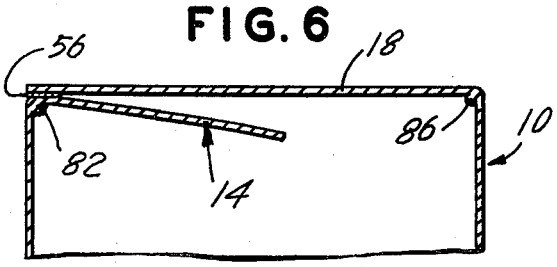
FIG. 6 shows a cross-sectional view of a prior art carton sealed closed but with drooping flaps which limit the sealing margin.

Frequently the fold lines for the lower underlying flaps are roll or crease scores which may extend through the entire thickness of the carton. A roll or crease score has a springiness which tends to force or bias the flap 18 upward as shown particularly in FIG. 3. In FIGS. 3,4 and 6 the roll or crease scores are shown at 80,82,84,86. When the flap is folded the roll score shows as a ridge along the fold line.

In FIG. 3 the sealing margin 62 is shown biased upward by the roll score 82. The top 18 is biased upward by the roll score 86. Hot gases from the nozzle 50 heat the bottom of the top flap 18 and the top of the bottom flaps 12,14,16. The inner margin 68 bows downward. The sealing margin 62 may also bow slightly but substantially less than the margin 68, whereby the cut score allows the seal 98 between the top 18 and the margin 62 when the top 18 is pressed downward to engage the two hot surfaces.

It frequently happens that a straight cut score will tear when the carton blank is handled by automatic machinery. It is, therefore, desirable that the cut scores 20,22,24 be of alternate configurations such as those shown in FIG. 5. FIG. 5*a* shows an undulating cut score. FIG. 5*b* shows an interrupted straight cut score. FIG. 5*c* shows a sawtooth score with the points slightly rounded. FIG. 5*c* shows a trapezoidal score with the discontinuities slightly rounded. All of these cut scores may be used, and they are stronger than the straight cut scores shown in FIG. 2.

Thus, the use of a cut score on the closure flaps avoids the pulling away of the underlying flaps from the overlying flaps during sealing of the carton.

Although the invention has been described in detail above, it is not intended that the invention shall be limited by that description alone, but only in accordance with the spirit and scope of the appended claims.

I claim:

1. A carton having four sides and at least one end closure, at least one of said closures having at least one underlying flap and an overlying flap, said underlying flaps being hinged by upwardly biased crease scores to said sides;

at least one of said underlying flaps having a line of weakness substantially its full length to define sealing margins between said lines of weakness and said crease scores of said underlying flaps, said sealing margins being attachable to said overlying flap.

2. The combination of claim 1 in which at least one of said end closures has three underlying flaps and an overlying flap, said underlying flaps being hinged by upwardly biased crease scores to three of said sides, respectively, to define sealing margins between said lines of weakness and said crease scores of said underlying flaps.

3. The combination of claim 1 in which said lines of weakness are cut scores substantially the full length of said underlying flaps to form sealing margins between said cut scores and the upwardly biased crease score hinges of said flaps.

4. The combination of claim 1 in which each of said end closures has three underlying flaps and an overlying flap, said underlying flaps being hinged by upwardly biased crease scores to three of said sides, respectively, to define sealing margins between said lines of weakness and said upwardly biased crease score hinges of said underlying flaps.

5. The combination of claim 1 in which said lines of weakness are continuous cut scores substantially the full length of said underlying flaps to form sealing margins between said cut scores and the upwardly biased crease score hinges of said underlying flaps.

6. The combination of claim 1 in which at least one of said lines of weakness is an intermittent straight line cut score.

7. A carton blank having four side panels and at least one set of panels forming at least one end closure, each said set of panels having at least one underlying flap panel and an overlying flap panel, said underlying flap panels each being hinged by crease scores to said side panels in an orientation to cause an assembled carton to have said underlying panels upwardly biased;

at least one of said underlying flap panels in each said set of panels having a line of weakness substantially its full length to define sealing margins between its said line of weakness and its said crease score for attachment to its overlying panel in the same said set of panels.

* * * * *